US011175614B2

(12) United States Patent
Nakajima

(10) Patent No.: US 11,175,614 B2
(45) Date of Patent: Nov. 16, 2021

(54) IMAGE FORMING APPARATUS THAT CONTROLS A FIXING TEMPERATURE OF A TONER CARTRIDGE

(71) Applicant: TOSHIBA TEC KABUSHIKI KAISHA, Tokyo (JP)

(72) Inventor: Takahiro Nakajima, Kawasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/810,884

(22) Filed: Mar. 6, 2020

(65) Prior Publication Data

US 2021/0278788 A1 Sep. 9, 2021

(51) Int. Cl.
*G03G 15/20* (2006.01)
*G03G 21/18* (2006.01)
*G03G 21/20* (2006.01)

(52) U.S. Cl.
CPC ..... *G03G 15/2039* (2013.01); *G03G 21/1875* (2013.01); *G03G 21/1889* (2013.01); *G03G 21/20* (2013.01)

(58) Field of Classification Search
CPC ..... G03G 15/2039; G03G 21/1875; G03G 21/1889; G03G 21/20; G03G 21/00071; G03G 21/00084
See application file for complete search history.

(56) References Cited

U.S. PATENT DOCUMENTS

2011/0217059 A1* 9/2011 Kato ..... G03G 15/20 399/43
2012/0263489 A1* 10/2012 Takeuchi ..... G03G 15/2039 399/69
2017/0261911 A1* 9/2017 Ogawa ..... G03G 15/80
2019/0163101 A1* 5/2019 Lindig ..... G03G 15/2053

FOREIGN PATENT DOCUMENTS

JP 2007-163884 6/2007

* cited by examiner

*Primary Examiner* — Joseph S Wong
(74) *Attorney, Agent, or Firm* — Amin, Turocy & Watson, LLP

(57) ABSTRACT

According to one example, an image forming apparatus includes a detection unit that detects temperature information on a temperature of a toner stored in a toner cartridge, an image forming unit that forms a toner image on a sheet with the toner supplied from the toner cartridge, a fixing unit that fixes the toner image formed on the sheet by the image forming unit, and a control unit that controls a fixing temperature in the fixing unit according to the temperature information detected by the detection unit and an accumulated time in which the temperature information is detected.

20 Claims, 11 Drawing Sheets

| | | DETECTED TEMPERATURE | | |
|---|---|---|---|---|
| | | ~35°C | 35°C~40°C | 40°C~ |
| ACCUMULATED TIME | 25H | CATEGORY 1 | CATEGORY 1 | CATEGORY 2 |
| | 75H | CATEGORY 1 | CATEGORY 2 | CATEGORY 2 |
| | 100H | CATEGORY 1 | CATEGORY 2 | CATEGORY 3 |

FIG. 8

| | |
|---|---|
| A1 | IDENTIFICATION CODE |
| A2 | CHARACTERISTIC INFORMATION A |

FIG. 9

| | |
|---|---|
| B1 | IDENTIFICATION CODE |
| B2 | CHARACTERISTIC INFORMATION B |
| B3 | TEMPERATURE INFORMATION |

FIG. 10

| | | DETECTED TEMPERATURE | | |
|---|---|---|---|---|
| | | ~35°C | 35°C~40°C | 40°C~ |
| ACCUMULATED TIME | 25H | CATEGORY 1 | CATEGORY 1 | CATEGORY 2 |
| | 75H | CATEGORY 1 | CATEGORY 2 | CATEGORY 2 |
| | 100H | CATEGORY 1 | CATEGORY 2 | CATEGORY 3 |

FIG. 11

| CATEGORY | CATEGORY 1 | CATEGORY 2 | CATEGORY 3 |
|---|---|---|---|
| CORRECTED TEMPERATURE | 0°C | +5°C | +10°C |

FIG. 12

| ~35°C | 35°C~40°C | 40°C~ |
|---|---|---|
| ACCUMULATED TIME | ACCUMULATED TIME | ACCUMULATED TIME |

FIG. 15

| | DETECTED TEMPERATURE | ACCUMULATED TIME | CATEGORY | OFFSET |
|---|---|---|---|---|
| APPLICATION EXAMPLE 1 | 35°C | 203H | CATEGORY 1 | NO |
| APPLICATION EXAMPLE 2 | 40°C | 24H | CATEGORY 1 | NO |
| APPLICATION EXAMPLE 3 | 39°C | 72H | CATEGORY 2 | NO |
| APPLICATION EXAMPLE 4 | 39°C | 195H | CATEGORY 2 | NO |
| APPLICATION EXAMPLE 5 | 42°C | 23H | CATEGORY 2 | NO |
| APPLICATION EXAMPLE 6 | 41°C | 73H | CATEGORY 2 | NO |
| APPLICATION EXAMPLE 7 | 42°C | 191H | CATEGORY 3 | NO |
| NON-APPLICATION EXAMPLE 1 | 40°C | 74H | CATEGORY 1 | YES |
| NON-APPLICATION EXAMPLE 2 | 38°C | 196H | CATEGORY 1 | YES |
| NON-APPLICATION EXAMPLE 3 | 41°C | 23H | CATEGORY 1 | YES |
| NON-APPLICATION EXAMPLE 4 | 43°C | 71H | CATEGORY 1 | YES |
| NON-APPLICATION EXAMPLE 5 | 42°C | 197H | CATEGORY 1 | YES |
| NON-APPLICATION EXAMPLE 6 | 43°C | 199H | CATEGORY 2 | YES |

FIG. 16

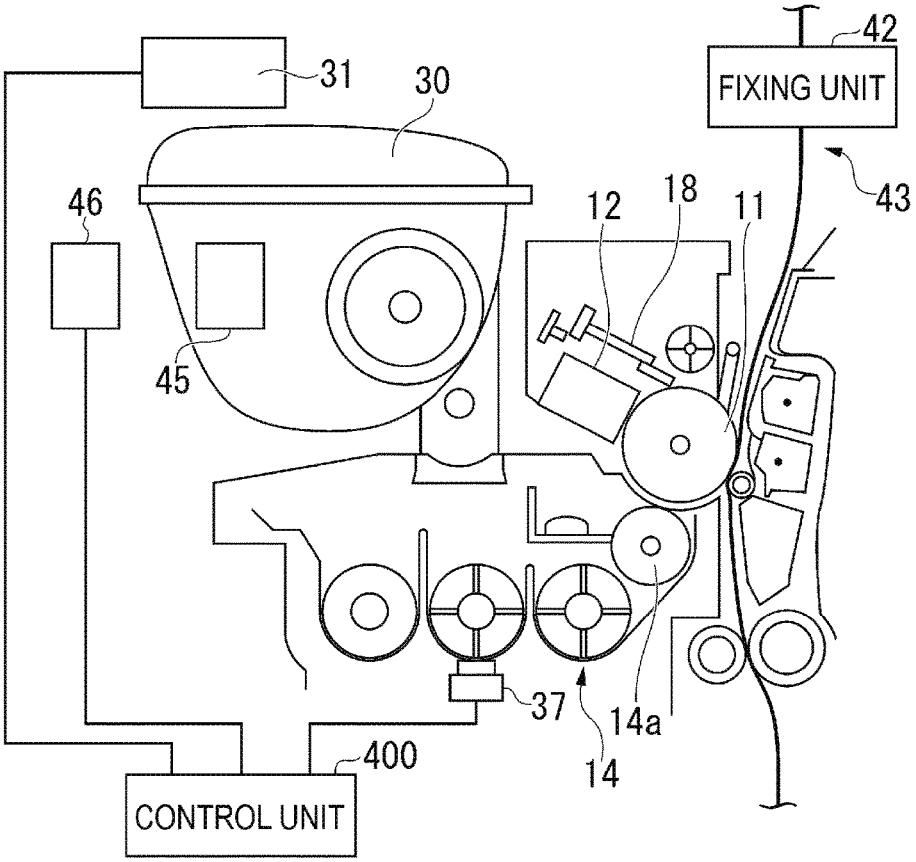

FIG. 19

| | DETECTED TEMPERATURE | ACCUMULATED TIME | CATEGORY | OFFSET |
|---|---|---|---|---|
| APPLICATION EXAMPLE 1 | 34°C | 95H | CATEGORY 1 | NO |
| APPLICATION EXAMPLE 2 | 35°C | 720H | CATEGORY 1 | NO |
| APPLICATION EXAMPLE 3 | 39°C | 24H | CATEGORY 1 | NO |
| APPLICATION EXAMPLE 4 | 40°C | 53H | CATEGORY 2 | NO |
| APPLICATION EXAMPLE 5 | 40°C | 158H | CATEGORY 2 | NO |
| APPLICATION EXAMPLE 6 | 42°C | 20H | CATEGORY 2 | NO |
| APPLICATION EXAMPLE 7 | 42°C | 66H | CATEGORY 2 | NO |
| APPLICATION EXAMPLE 8 | 43°C | 133H | CATEGORY 3 | NO |
| NON-APPLICATION EXAMPLE 1 | 39°C | 29H | CATEGORY 1 | YES |
| NON-APPLICATION EXAMPLE 2 | 40°C | 87H | CATEGORY 1 | YES |
| NON-APPLICATION EXAMPLE 3 | 41°C | 12H | CATEGORY 1 | YES |
| NON-APPLICATION EXAMPLE 4 | 41°C | 29H | CATEGORY 1 | YES |
| NON-APPLICATION EXAMPLE 5 | 42°C | 81H | CATEGORY 2 | YES |
| NON-APPLICATION EXAMPLE 6 | 43°C | 110H | CATEGORY 2 | YES |

IMAGE FORMING APPARATUS THAT CONTROLS A FIXING TEMPERATURE OF A TONER CARTRIDGE

FIELD

Embodiments described herein relate generally to an image forming apparatus, a toner cartridge, and an image forming method.

BACKGROUND

There is an image forming apparatus using a toner that can be fixed at a low temperature. The image forming apparatus can reduce power consumption by using a toner that can be fixed at a low temperature. In the image forming apparatus, a toner is supplied from a toner cartridge mounted on the image forming apparatus. The toner in the toner cartridge is exposed to heat generated in the image forming apparatus. As a cause of generation of heat in the image forming apparatus, a long-time continuous double-sided copying operation or the like can be mentioned.

A toner that can be fixed at a low temperature has a characteristic that when exposed to a high temperature, the glass transition point of the toner increases. When the glass transition point of the toner increases, the toner becomes difficult to melt, and thus there is a problem that a cold offset occurs.

DESCRIPTION OF THE DRAWINGS

FIG. 8 is a view illustrating information stored in a storage medium 35;

FIG. 9 is a view illustrating information stored in a DRAM 310;

FIG. 10 is a view illustrating category determination information;

FIG. 11 is a view illustrating correction information;

FIG. 12 is a view illustrating temperature information;

FIG. 15 is a view illustrating the presence of an offset when the first example is applied to some cases and when the first example is not applied;

FIG. 16 is a block view illustrating a configuration for realizing a second example;

FIG. 19 is a view illustrating the presence of an offset when the second example is applied to some cases and when the second example is not applied.

DETAILED DESCRIPTION

An image forming apparatus according to an embodiment includes a detection unit, an image forming unit, a fixing unit, and a control unit. The detection unit detects temperature information on the temperature of a toner stored in a toner cartridge. The image forming unit forms a toner image on a sheet with the toner supplied from the toner cartridge. The fixing unit fixes the toner image formed on the sheet by the image forming unit. The control unit controls a fixing temperature in the fixing unit according to the temperature information detected by the detection unit and an accumulated time in which the temperature information is detected. An image forming method involves detecting temperature information of a temperature of a toner stored in a toner cartridge; forming a toner image on a sheet with the toner supplied from the toner cartridge; fixing the toner image formed on the sheet; and controlling a fixing temperature according to the temperature information detected and an accumulated time in which the temperature information is detected.

Figure 1:
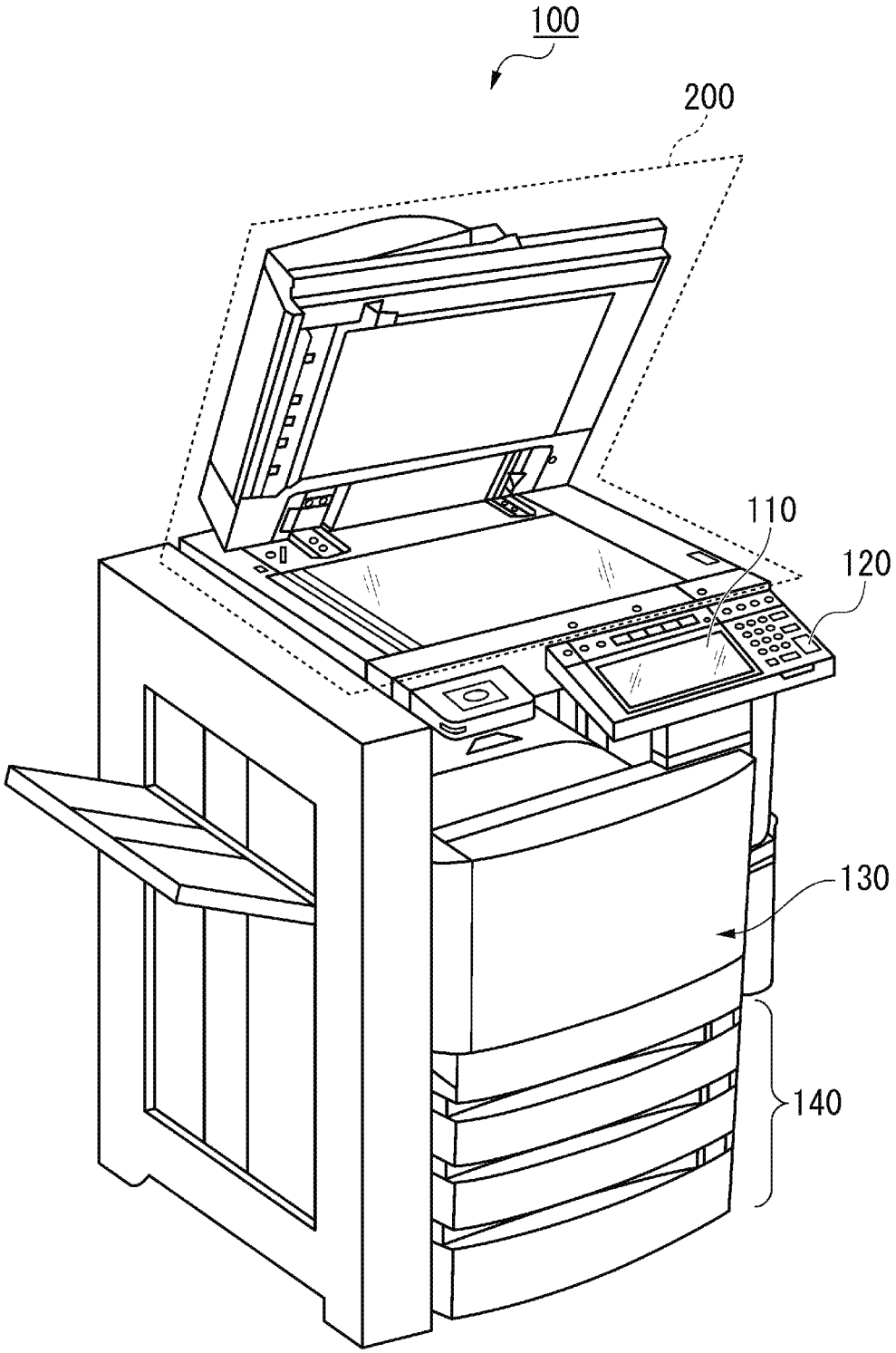
FIG. 1 is an external view illustrating an example of an overall configuration of an image forming apparatus 100 according to an embodiment.
Figure 2:
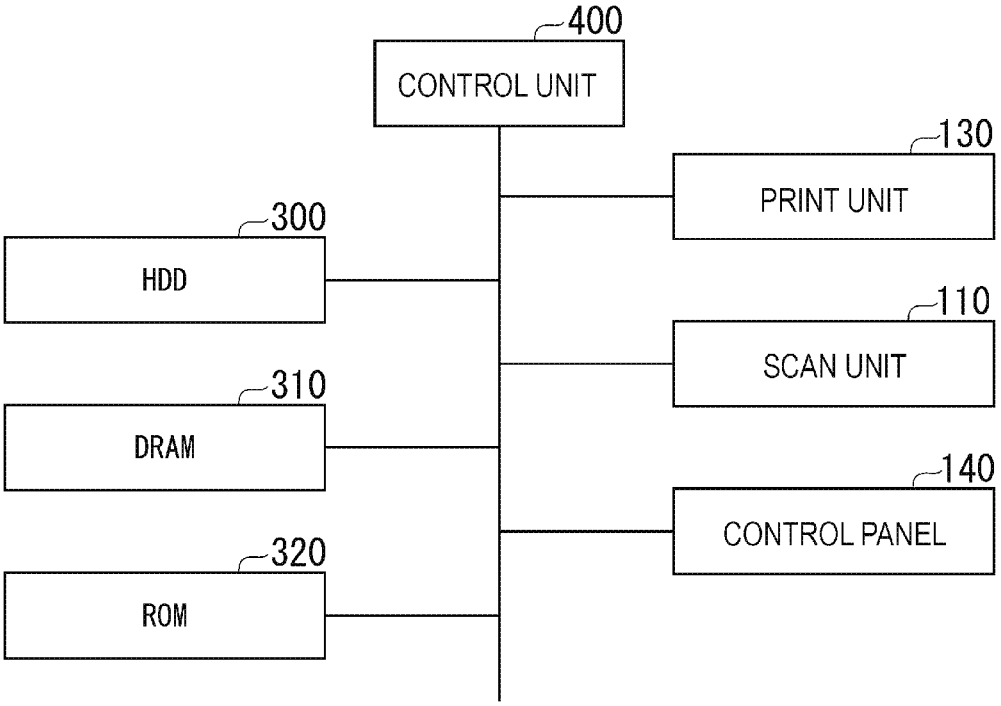
FIG. 2 is a view illustrating a configuration of a control system of the image forming apparatus 100.

FIG. 1 is an external view illustrating an example of an overall configuration of the image forming apparatus 100 according to the embodiment. The image forming apparatus 100 is, for example, a multifunction peripheral. The image forming apparatus 100 includes a display 110, a control panel 120, a printing unit 130, a sheet storage unit 140, and a scanning unit 200. The image forming apparatus 100 includes a control unit 400 that controls the entire apparatus as illustrated in FIG. 2.

The image forming apparatus 100 forms an image on a sheet by using a developer. The developer is, for example, a toner. In the following description, the developer is described as a toner. The sheet is, for example, paper or label paper. The sheet may be of any type as long as the image forming apparatus 100 can form an image on the surface thereof.

The display 110 is an image display device such as a liquid crystal display, an organic electro luminescence (EL) display, or the like. The display 110 displays various information related to the image forming apparatus 100.

The control panel 120 includes a plurality of buttons. The control panel 120 receives user operations. The control panel 120 outputs a signal corresponding to the operation performed by the user to the control unit 400 of the image forming apparatus 100. The display 110 and the control panel 120 may be configured as an integral touch panel.

The printing unit 130 prints an image on a sheet based on image information generated by the scanning unit 200 or image information received via a network. The printing unit 130 prints an image by using a toner. The sheet on which an image is to be printed may be a sheet stored in the sheet storage unit 140 or may be a sheet set by hand. The sheet storage unit 140 stores a sheet used for image formation in the printing unit 130.

The scanning unit 200 reads image information to be read as light and darkness. The scanning unit 200 records the read image information. The recorded image information may be transmitted to another information processing apparatus via a network. The recorded image information may be formed on the sheet by the printing unit 130.

FIG. 2 is a view illustrating a configuration of a control system of the image forming apparatus 100. The image forming apparatus 100 includes the printing unit 130, the scanning unit 200, the control panel 120, the control unit 400, a hard disk drive (HDD) 300, a dynamic random access memory (DRAM) 310, and a read only memory (ROM) 320. These components are connected via a system bus.

The control unit 400 controls each component connected via the system bus. The ROM 320 stores various control programs necessary for the operation of the image forming apparatus 100. The ROM 320 stores each program for controlling an image forming operation and the like. The HDD 300 stores each program and each pieces of data. Execution of each program stored in the ROM 320 and the HDD 300 is controlled by the control unit 400. The DRAM 310 is a buffer memory that temporarily stores data generated when each program is executed.

Next, the glass transition point of the toner will be described. The image forming apparatus 100 forms a toner image on a sheet with the toner supplied from the toner cartridge. The toner used by the image forming apparatus 100 is a toner that can be fixed at a lower temperature than a general toner.

Figure 3:
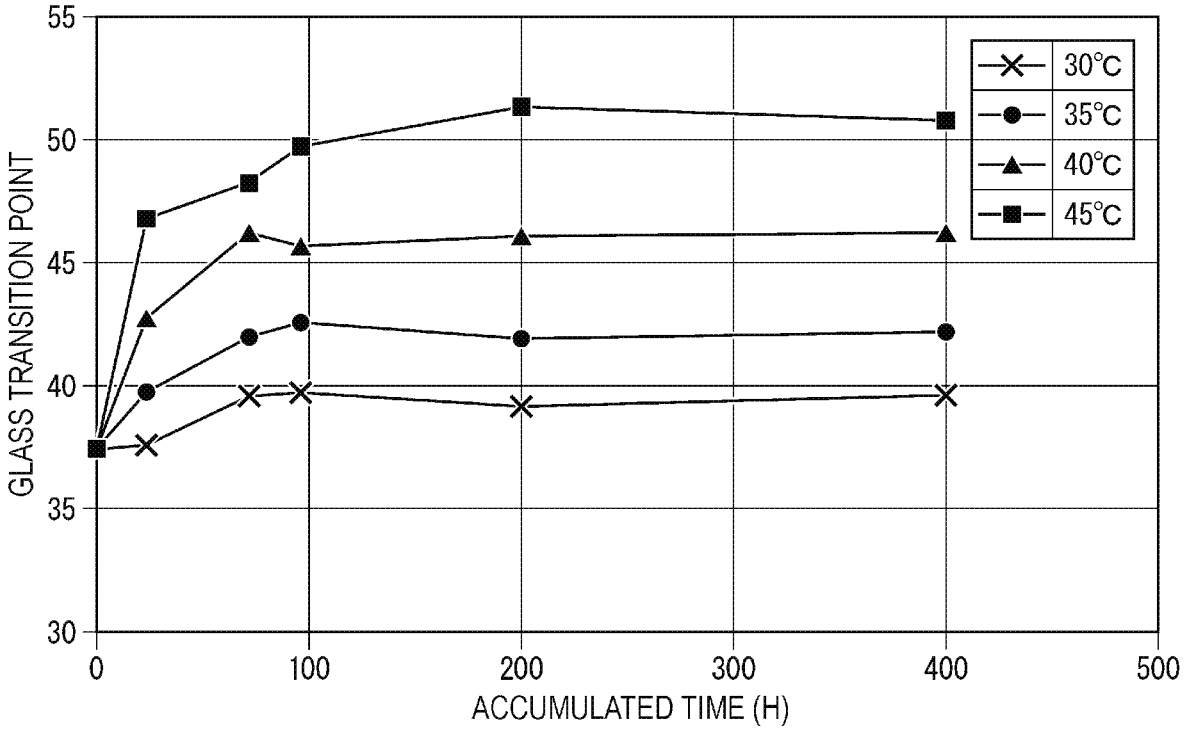
FIG. 3 is a view illustrating a change in a glass transition point.

The toner cartridge is set in the image forming apparatus 100. Therefore, the toner in the toner cartridge is exposed to the heat generated in the image forming apparatus 100. When the toner is exposed to heat, the glass transition point increases. FIG. 3 is a view illustrating a change in the glass transition point.

In FIG. 3, the horizontal axis indicates an accumulated time (H). The accumulated time is a time obtained by accumulating a time in which the toner is exposed at a certain temperature. The vertical axis indicates the change in the glass transition point. In FIG. 3, the temperature at which the toner is exposed is 30° C., 35° C., 40° C., and 45° C.

As illustrated in FIG. 3, at any temperature, the glass transition point sharply increases until the accumulated time reaches 100 hours. When the accumulated time exceeds 200 hours, the glass transition point hardly changes. The higher the exposure temperature, the higher the glass transition point of the toner. For example, the glass transition point when exposed at 30° C. is about 40° C. On the other hand, the glass transition point when exposed at 45° C. is about 50° C.

Figure 4:
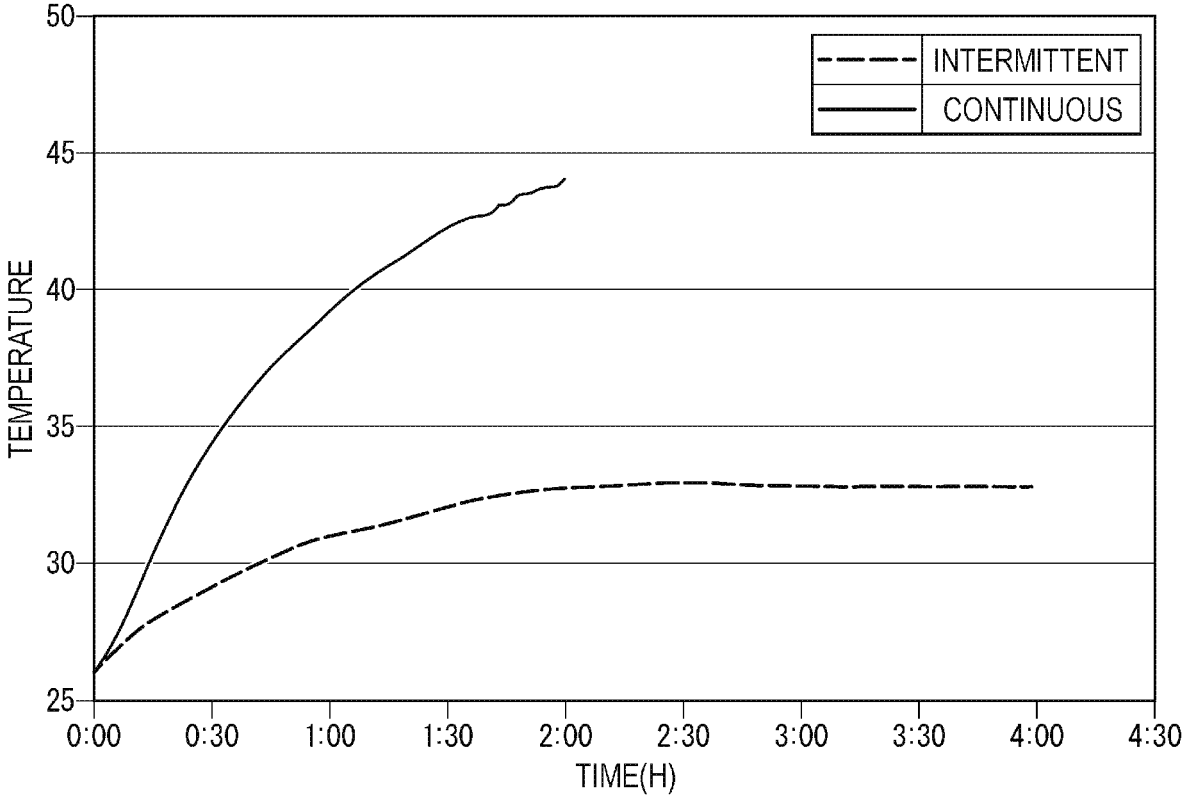
FIG. 4 is a view illustrating a change in temperature in the image forming apparatus 100.

FIG. 4 is a view illustrating a change in a temperature in the image forming apparatus 100. The horizontal axis indicates time. The vertical axis indicates a change in the temperature. In FIG. 4, temperature changes when the image forming apparatus 100 operates intermittently and when the image forming apparatus 100 continuously operates are illustrated. The continuous operation refers to, for example, an operation of continuously performing a large amount of double-sided copying. The intermittent operation refers to an operation of intermittently performing a small amount of copying or the like.

As illustrated in FIG. 4, when the continuous operation is performed, the temperature rises more rapidly than when the intermittent operation is performed. The temperature reached when performing the continuous operation is far higher than the temperature reached when performing the intermittent operation. For example, the temperature after a lapse of 2 hours is about 44° C. for the continuous operation and about 33° C. for the intermittent operation. Therefore, the glass transition point of the toner tends to increase as the image forming apparatus performs the continuous operation.

Figure 5:
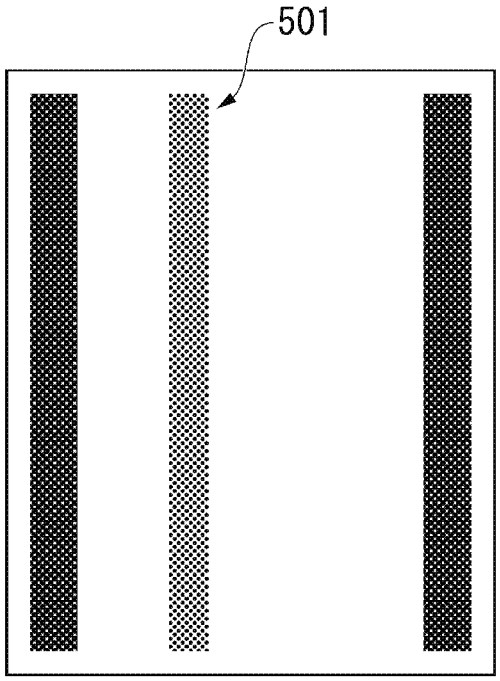
FIG. 5 is a view illustrating an example of occurrence of a cold offset.
Figure 6:
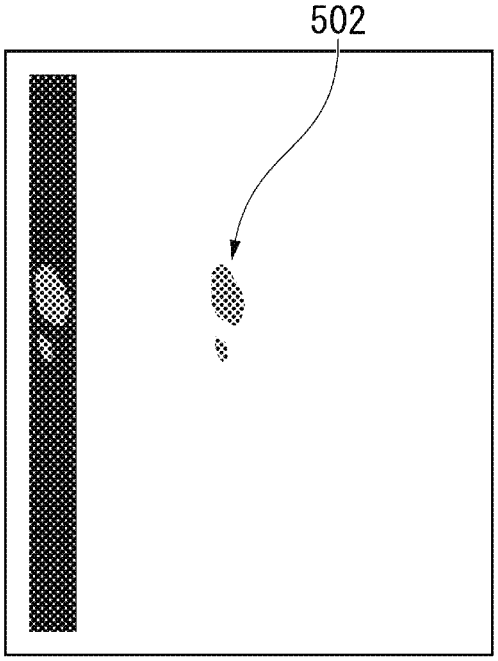
FIG. 6 is a view illustrating an example of occurrence of a cold offset.

When the glass transition point of the toner increases, a cold offset occurs due to the toner that does not melt at the same fixing temperature as before. FIGS. 5 and 6 are views illustrating examples of occurrence of the cold offset. FIGS. 5 and 6 illustrate examples of occurrence of the cold offset when a black belt-like image in the vertical direction is formed on the sheet.

FIG. 5 is a view illustrating an example of occurrence of the cold offset when the toner forming a belt-like image remains without melting over almost the entire area. A belt-like image 501 is an image formed on a sheet by the toner adhered to the fixing unit without being melted. FIG. 6 is a view illustrating an example of occurrence of the cold offset when a part of the toner forming the belt-like image remains without melting. An image 502 is an image formed on a sheet by the toner adhered to the fixing unit without being melted.

When a cold offset occurs in such manner, an unintended image is formed on the sheet by the toner adhered to the fixing unit without being melted. The occurrence of the cold offset is not preferred. Two examples (first example and second example) for preventing the occurrence of the cold offset will be described. In the following description, processing for preventing the occurrence of the cold offset is referred to as prevention processing.

Figure 7:
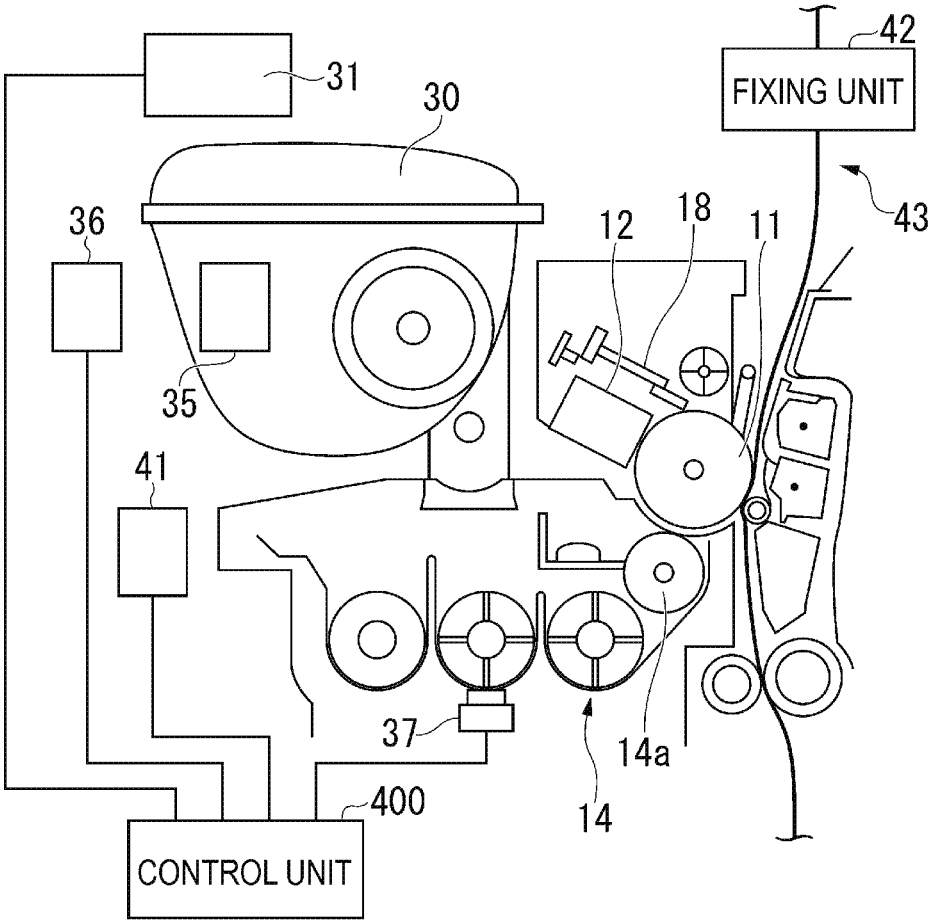
FIG. 7 is a block view illustrating a configuration for realizing a first example.

FIG. 7 is a block view illustrating a configuration for realizing the first example. In FIG. 7, the control unit 400, a toner cartridge 30, a toner supply motor 31, a storage medium 35, a read and write unit 36, and a remaining toner detection sensor 37 are illustrated. In FIG. 7, a photoconductive drum 11, a charger 12, a developing device 14, a developing drum 14*a*, and a cleaner 18 are illustrated. In FIG. 7, a temperature sensor 41 and a fixing unit 42 are illustrated.

The photoconductive drum 11 includes an organic photo conductor (OPC) on the surface of a support member. The charger 12 uniformly charges the photoconductive drum 11 sequentially according to the rotation of the photoconductive drum 11. The cleaner 18 removes the remaining toner on the photoconductive drum 11. The developing device 14 develops the electrostatic latent image formed on the photoconductive drum 11 with the toner by using the developing drum 14*a*.

As illustrated in the upper part of FIG. 7, the toner cartridge 30 is provided on the upper part of the developing device 14. By the rotation of the toner supply motor 31, the supply mechanism (supply auger) in the toner cartridge 30 is driven, and the toner is dropped into the developing device 14 to be supplied.

The developing device 14 is provided with the remaining toner detection sensor 37 that measures the magnetic permeability of the developer. The remaining toner detection sensor 37 acquires a toner amount indicating the amount of the toner stored in the developing device 14. A toner shortage can be detected by the measurement value of the remaining toner detection sensor 37.

A conveyance path 43 indicates a sheet conveyance path. The toner image formed on the developing drum 14*a* is transferred to a sheet. The toner image transferred to the sheet is fixed by the fixing unit 42. Thereafter, the sheet is discharged out of the machine.

In the present embodiment, the image forming unit includes the photoconductive drum 11, the charger 12, the developing device 14, the developing drum 14*a*, and the cleaner 18 described above.

The toner cartridge 30 includes the storage medium 35. The storage medium 35 stores characteristic information determined by the characteristics of the toner stored in the toner cartridge 30. When the toner cartridge 30 is set in the image forming apparatus 100, the toner cartridge 30 and the image forming apparatus 100 are electrically connected via a bus. The read and write unit 36 reads information from and writes information to the storage medium 35.

The characteristic information includes information stored in the storage medium 35 and information stored in the main body of the image forming apparatus 100. In order to distinguish the two pieces of information, the information stored in the storage medium 35 is referred to as characteristic information A, and the information stored in the main body of the image forming apparatus 100 is referred to as characteristic information B. When the characteristic information A and the characteristic information B are not distinguished, the two pieces of information are expressed as characteristic information.

The image forming apparatus 100 can acquire the characteristic information A from the toner cartridge 30 when the toner cartridge 30 is set in the image forming apparatus 100 and the cover that stores the toner cartridge 30 is closed. The acquired characteristic information A is stored in the image forming apparatus 100 as characteristic information B.

The temperature sensor 41 detects the temperature in the image forming apparatus 100 in which the toner cartridge 30 is stored. The temperature sensor 41 is disposed near the toner cartridge 30. Therefore, the temperature detected by the temperature sensor 41 is the temperature at which the toner is exposed.

The above-described toner supply motor 31, the read and write unit 36, the remaining toner detection sensor 37, the temperature sensor 41, and the fixing unit 42 are controlled by the control unit 400.

The information stored in the storage medium 35 will be described. FIG. 8 is a view illustrating the information stored in the storage medium. The storage medium 35 stores an identification code and the characteristic information A. A1 and A2 illustrated in FIG. 8 indicate the head addresses where the respective information is stored. The identification code is information for determining whether the toner cartridge 30 is a genuine product.

Information stored in the DRAM 310 will be described. FIG. 9 is a view illustrating information stored in the DRAM 310. The identification code and the characteristic information B are stored in the DRAM 310. B1, B2, and B3 illustrated in FIG. 9 indicate the head address where the respective information is stored. The identification code is information for identifying the toner cartridge 30 acquired from the storage medium 35. Therefore, the same identification information as that of the storage medium 35 is stored. The temperature information indicates the accumulated time in which the toner cartridge is exposed at a certain temperature.

The characteristic information includes two types of information. One is category determination information for determining a category indicating a corrected temperature. The other is correction information indicating a corrected temperature corresponding to the determined category. The corrected temperature indicates a temperature at which the fixing unit 42 is corrected to be.

FIG. 10 is a view illustrating category determination information. The category determination information is information for determining a category from the detected temperature and the accumulated time. The detected temperature indicates a temperature detected by the temperature sensor 41. The accumulated time indicates the accumulated time of exposure at the detected temperature. There are Category 1, Category 2 and Category 3. Any of Category 1, Category 2, and Category 3 is determined by the category determination information. The corrected temperature increases in the order of Category 1, Category 2, and Category 3.

When the detected temperature is lower than 35° C. according to the category determination information illustrated in FIG. 10, Category 1 is determined regardless of the accumulated time. When the detected temperature is 35° C. or higher and lower than 40° C., if the accumulated time is less than 25 hours, Category 1 is determined. When the detected temperature is 35° C. or higher and lower than 40° C., if the accumulated time is 25 hours or longer, Category 2 is determined. When the detected temperature is 40° C. or higher, if the accumulated time is less than 75 hours, Category 2 is determined. When the detected temperature is 40° C. or higher, if the accumulated time is 75 hours or longer, Category 3 is determined. As described above, the characteristic information is information for correcting the fixing temperature to be higher as the temperature indicated by the temperature information is higher or the accumulated time is longer. A temperature range in which the detected temperature is lower than 35° C. or the detected temperature is 35° C. or higher and lower than 40° C. may be referred to as a "temperature zone".

FIG. 11 illustrates correction information. The correction information is information indicating a category and a corrected temperature corresponding to the category. In the case of Category 1, the corrected temperature is 0° C. That is, no correction is made for Category 1. In the case of Category 2, the corrected temperature is +5° C. Therefore, in the case of Category 2, the control unit 400 controls the temperature of the fixing unit 42 to be at a temperature obtained by adding 5° C. to a normal temperature. In the case of Category 3, the corrected temperature is +10° C. Therefore, in the case of Category 3, the control unit 400 controls the temperature of the fixing unit 42 to be at a temperature obtained by adding 10° C. to the normal temperature.

FIG. 12 is a view illustrating temperature information. The temperature information indicates the accumulated time of exposure at the temperature in the same temperature zone as the temperature zone of the detected temperature in FIG. 10. The unit of the accumulated time in the temperature information is minutes. Therefore, when comparing with the accumulated time of the category determination information in FIG. 10, the time is converted from minute to hour and compared. The temperature information is initialized at a predetermined timing (for example, at the time of toner replacement).

As described above, when acquiring the corrected temperature, the control unit 400 first acquires the temperature zone having the longest accumulated time from the temperature information. The control unit 400 determines a category from the acquired temperature zone and the accumulated time indicated in the temperature information by using the category determination information. For example, when the temperature zone is lower than 35° C. and the accumulated time indicated in the temperature information is 720 minutes (12 hours), Category 1 is determined. When the category is determined, the control unit 400 acquires a corrected temperature by using the correction information. For example, in the case of Category 2, +5° C. is acquired as the corrected temperature. The control unit 400 controls the temperature of the fixing unit 42 to be at a temperature obtained by adding the corrected temperature.

As described above, the characteristic information is information for correcting the fixing temperature based on the combination of the temperature information and the accumulated time.

Figure 13:
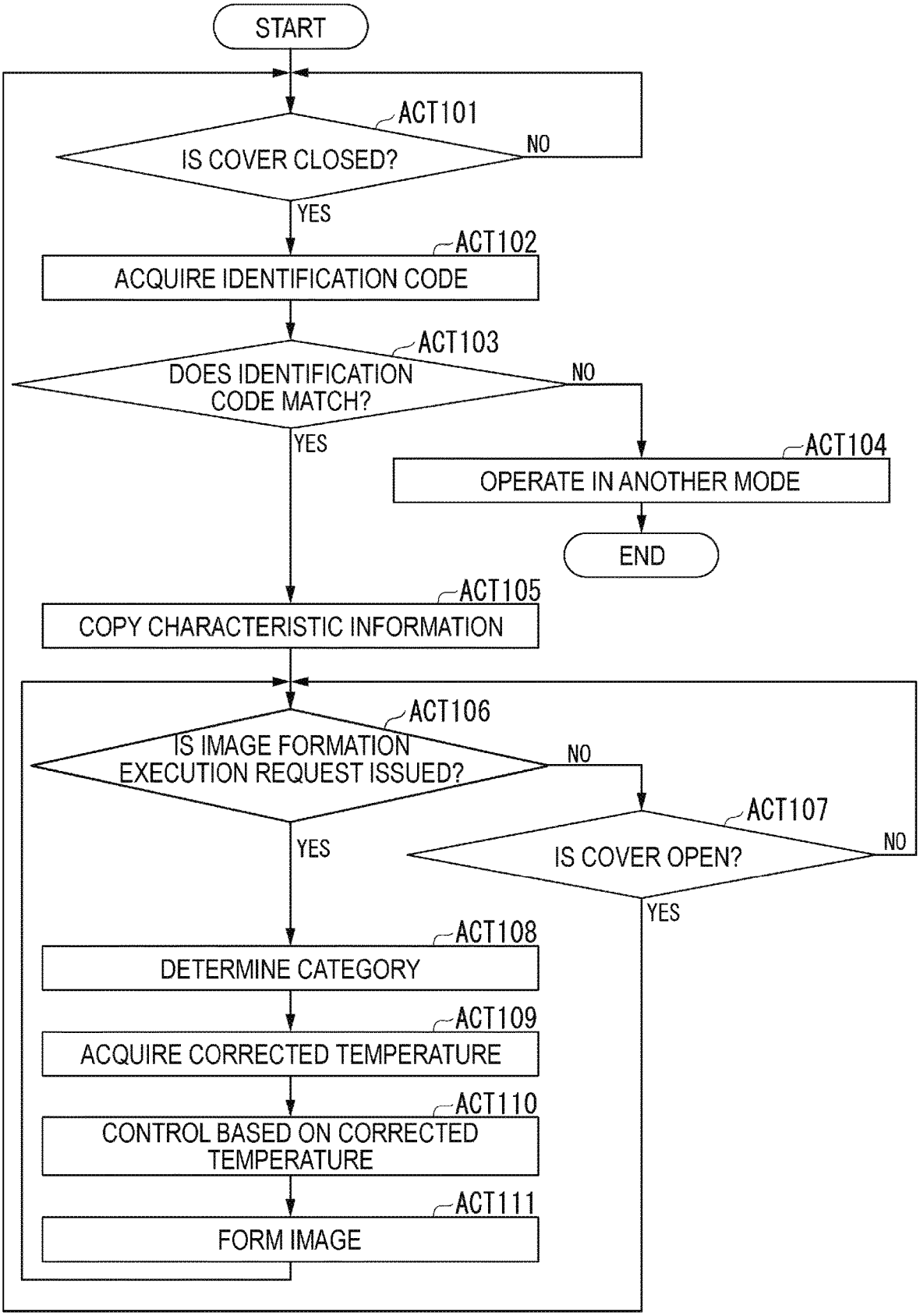
FIG. 13 is a flowchart illustrating a flow of prevention processing performed by a control unit 400.

FIG. 13 is a flowchart illustrating a flow of prevention processing performed by the control unit 400 in the first example. The control unit 400 determines whether the cover that stores the toner cartridge 30 is closed (ACT 101). If the cover is closed (ACT 101: YES), the identification code is acquired from the storage medium 35 (ACT 102).

The control unit 400 determines whether the acquired identification code matches the identification code stored in the DRAM 310 (ACT 103). If the acquired identification code does not match the identification code stored in DRAM 310 (ACT 103: NO), the control unit 400 operates in another mode in which prevention processing is not performed (ACT 104) and ends the processing. The case where the identification code does not match is the case where the set toner cartridge is an imitation product or the like.

If the acquired identification code matches the identification code stored in DRAM 310 (ACT 103: YES), the control unit 400 copies the characteristic information A to the characteristic information B (ACT 105).

The control unit 400 determines whether an image formation execution request is issued according to a user instruction or the like (ACT 106). If an image formation execution request is not issued (ACT 106: NO), the control unit 400 determines whether the cover is open (ACT 107). If the cover is open (ACT 107: YES), the process returns to ACT 101. If the cover is not opened (ACT 107: NO), the process returns to ACT 106.

When an image formation execution request is issued (ACT 106: YES), the control unit 400 determines a category (ACT 108) and acquires a corrected temperature from the category (ACT 109). The control unit 400 corrects the fixing temperature based on the acquired temperature and controls the fixing unit 42 to be at the corrected temperature (ACT 110). The control unit 400 forms an image (ACT 111) and returns to ACT 106.

Figure 14:
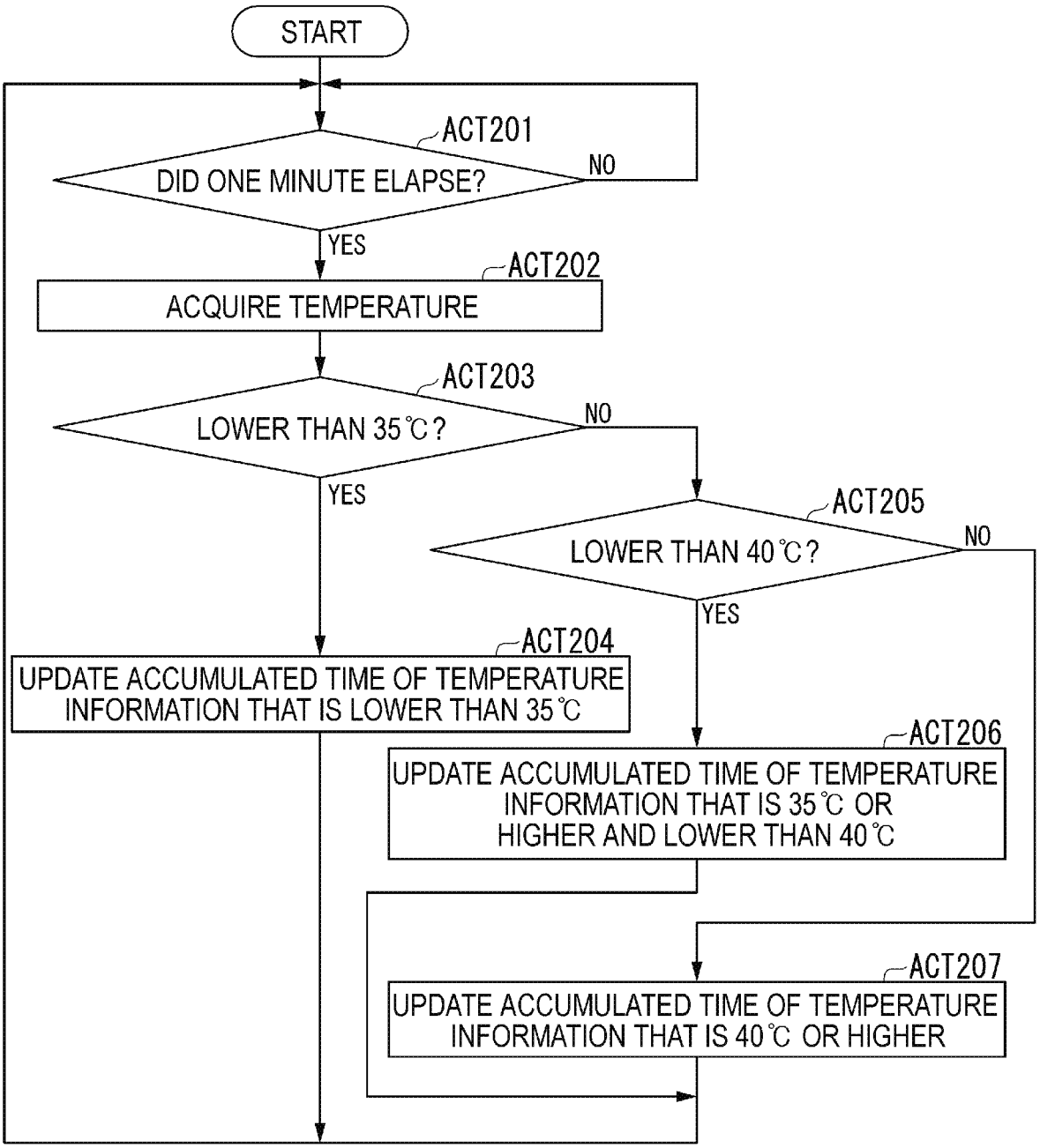
FIG. 14 is a flowchart illustrating a flow of temperature information update processing.

FIG. 14 is a flowchart illustrating the flow of temperature information updating processing. This temperature information updating processing is processing for updating the accumulated time of the temperature information illustrated in FIG. 12. The temperature information update processing is performed by the control unit 400 every second independently of the prevention processing illustrated in FIG. 13.

The control unit 400 acquires the temperature detected by the temperature sensor 41 every time one minute elapses (ACT 201: YES) (ACT 202). The control unit 400 determines whether the acquired temperature is lower than 35° C. (ACT 203). If the acquired temperature is lower than 35° C. (ACT 203: YES), the control unit 400 updates the accumulated time of temperature information lower than 35° C. (ACT 204) and returns to ACT 201. Updating the accumulated time means incrementing the accumulated time by one.

If the acquired temperature is not lower than 35° C. (ACT 203: NO), the control unit 400 determines whether the acquired temperature is lower than 40° C. (ACT 205). If the acquired temperature is lower than 40° C. (ACT 205: YES), the control unit 400 updates the accumulated time of temperature information lower than 40° C. (ACT 206) and returns to ACT 201. If the acquired temperature is not lower than 40° C. (ACT 205: NO), the control unit 400 updates the accumulated time of temperature information that is 40° C. or higher (ACT 207) and returns to ACT 201.

FIG. 15 is a view illustrating the presence of an offset when the first example is applied to some cases and when the first example is not applied. FIG. 15 illustrates "detected temperature", "accumulated time", "category", and presence of an offset for an application example or a non-application example. "Detected temperature", "accumulated time", and "category" are the same as "detected temperature", "accumulated time", and "category" described in FIG. 10.

In the test environment where the results illustrated in FIG. 15 were obtained, a paper basis weight of 60 g/m$^2$ at 10° C./20 wt % was used. The test environment was an environment in which the rated voltage was set to 90 V in an image forming apparatus having a rated voltage of 100 V. The method of checking the offset is a method of continuously forming 100 A4 sized solid band images with an image density of 1.3 to 1.4 to visually determine whether a cold offset such as FIG. 5 or FIG. 6 occurred.

As illustrated in FIG. 15, in the application example, the presence of an offset in Category 1, Category 2, and Category 3 is indicated. In the non-application example, the presence of an offset in Category 1 and Category 2 is illustrated.

As illustrated in FIG. 15, it is illustrated that no offset occurred in all application examples. On the other hand, it is illustrated that an offset occurred in all non-application examples. It is illustrated that the occurrence of an offset is actually prevented by applying the first example.

No offset was generated in all of the application examples even when the thermal characteristics of the toner were changed with time.

Next, the second example will be described. The second example will be described by using the configuration and the like described in the first example. The major difference between the second example and the first example is the function of the toner cartridge 30. The toner cartridge 30 according to the first example includes the storage medium 35. On the other hand, the toner cartridge 30 according to the second example includes an IC chip. The IC chip is a radio frequency identifier (RFID) with a built-in battery. The IC chip can detect a temperature and further includes a memory.

FIG. 16 is a block view illustrating a configuration for realizing the second example. The differences from the first example will be described. The configuration illustrated in FIG. 16 is a configuration in which the temperature sensor 41 and the read and write unit 36 are removed from the configuration described in FIG. 7 and an RFID reader 46 is included. The toner cartridge 30 includes an IC chip 45 instead of the storage medium 35. The RFID reader 46 communicates with the IC chip 45 and acquires various information.

The IC chip 45 stores temperature information in addition to the characteristic information A. In the first example, the temperature information is stored in the DRAM 310. On the other hand, in the second example, the temperature information is stored in the IC chip 45 since the IC chip 45 can detect the temperature. The IC chip 45 updates the temperature information by performing the temperature information updating processing illustrated in FIG. 14. In the second example, no identification code is used. Therefore, the identification code is not stored in the IC chip 45 or the DRAM 310.

As described above, the characteristic information A and the temperature information are stored in the IC chip 45. The DRAM 310 stores the characteristic information B. In the second example, when acquiring the corrected temperature, the control unit 400 first acquires the characteristic information A and stores the characteristic information A as the characteristic information B in the DRAM 310. The control unit 400 acquires temperature information from the IC chip 45. The control unit 400 acquires the temperature zone having the largest accumulated time from the temperature information. The control unit 400 determines a category from the acquired temperature zone and the accumulated time indicated in the temperature information by using the category determination information. When the category is determined, the control unit 400 acquires a corrected temperature by using the correction information.

Figure 17:
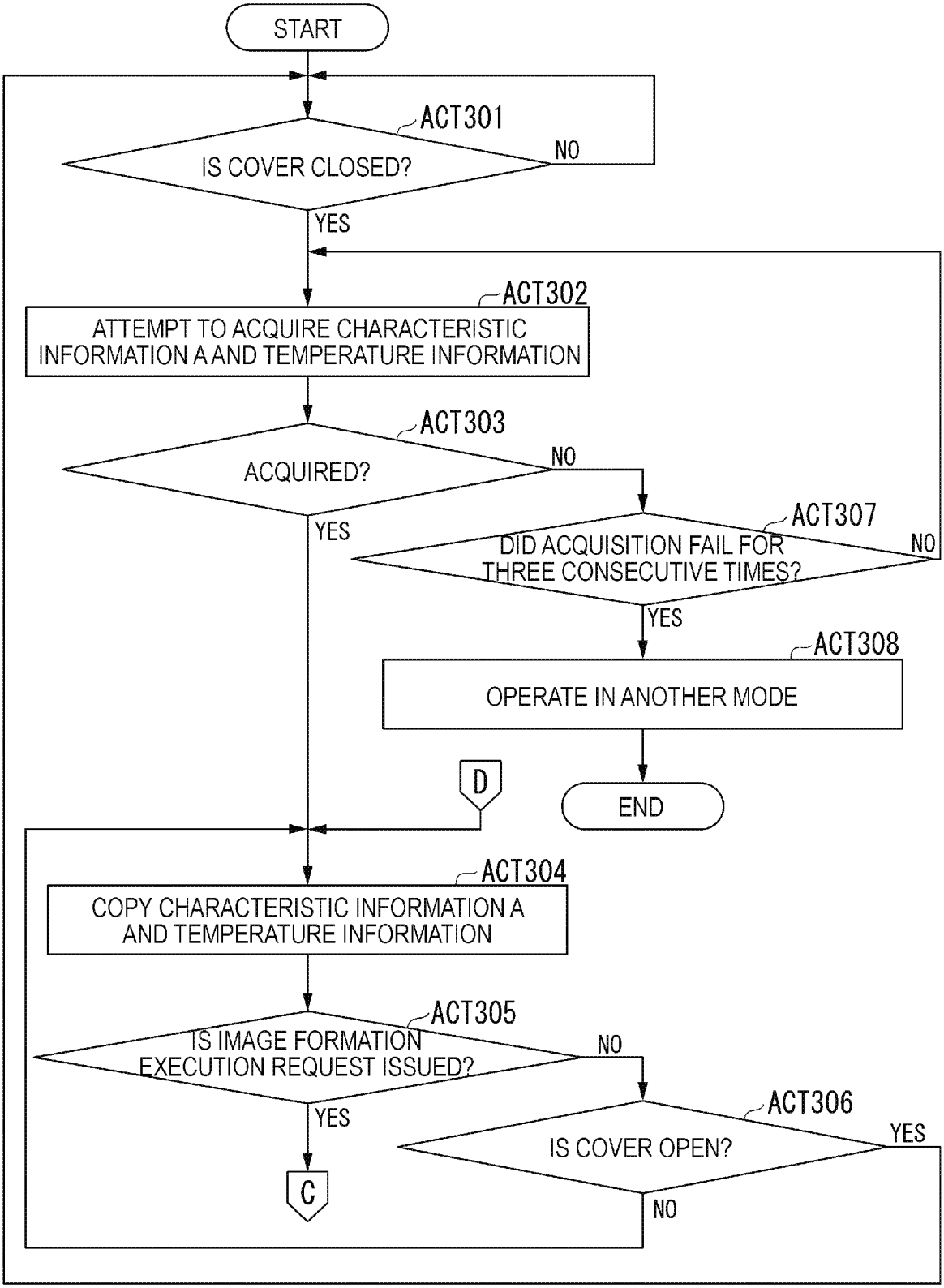
FIG. 17 is a flowchart illustrating a flow of prevention processing performed by the control unit 400.
Figure 18:
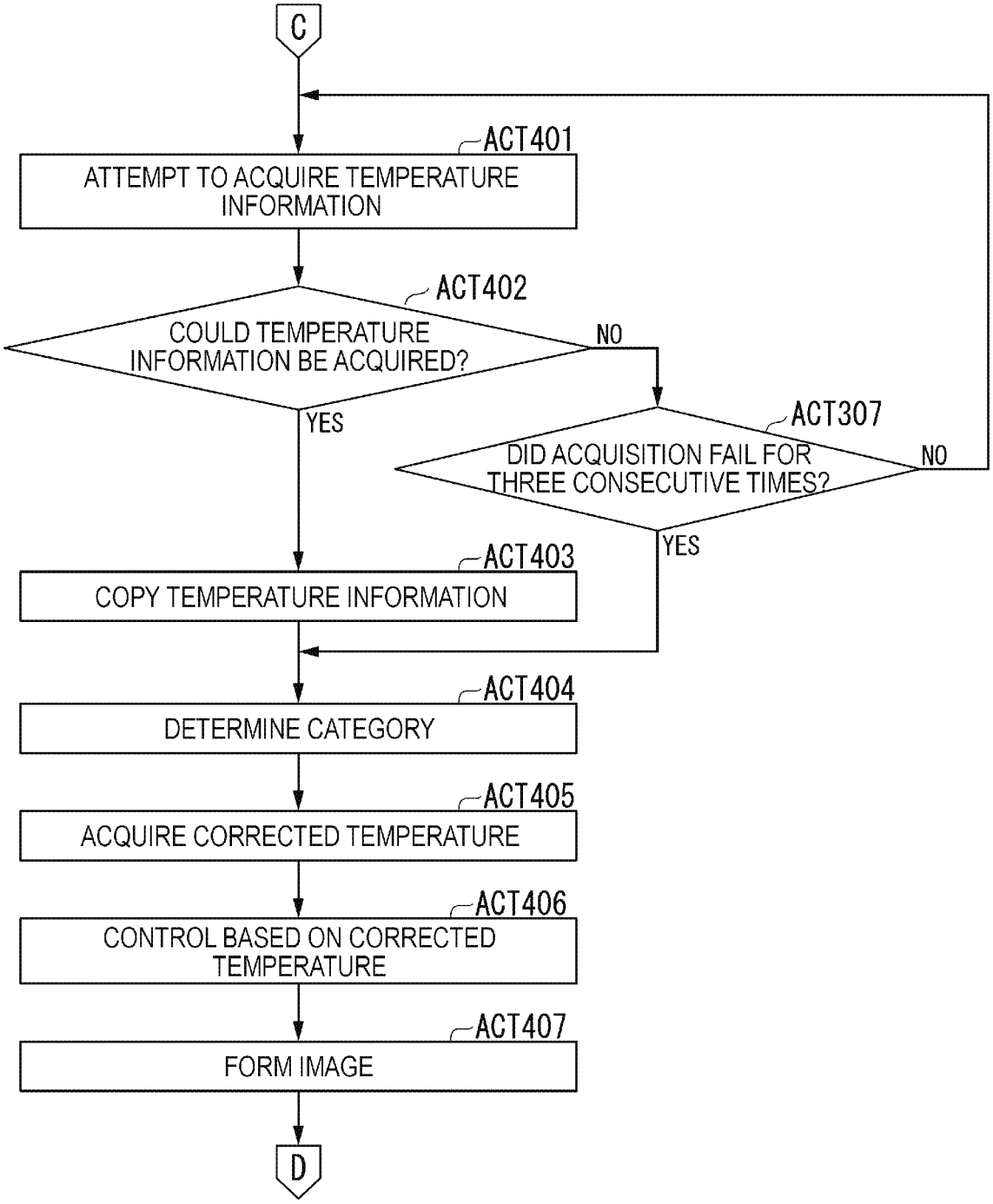
FIG. 18 is a flowchart illustrating a flow of prevention processing performed by the control unit 400.

FIGS. 17 and 18 are flowcharts illustrating a flow of prevention processing performed by the control unit 400 in the second example. The control unit 400 determines whether the cover for storing the toner cartridge 30 is closed (ACT 301). When the cover is closed (ACT 301: YES), the control unit 400 attempts to acquire the characteristic information A and the temperature information from the IC chip 45 (ACT 302).

The control unit 400 determines whether the characteristic information A and the temperature information are acquired (ACT 303). When the characteristic information A and the temperature information are not acquired (ACT 303: NO), the control unit 400 determines whether the acquisition of the characteristic information A and the temperature information failed for three consecutive times (ACT 307).

When the acquisition of the characteristic information A and the temperature information failed for three consecutive times (ACT 307: YES), the control unit 400 operates in another mode in which the prevention processing is not executed (ACT 308) and ends the processing. If the acquisition of the characteristic information A and the temperature information did not fail for three consecutive times (ACT 307: NO), the control unit 400 attempts to acquire the characteristic information A and the temperature information again (ACT 302).

When the characteristic information A and the temperature information are acquired (ACT 303: YES), the control unit 400 copies the characteristic information A to the characteristic information B and also copies the temperature information (ACT 304). The control unit 400 determines whether an image formation execution request is issued based on a user's instruction or the like (ACT 305). If an image formation execution request is not issued (ACT 305: NO), the control unit 400 determines whether the cover is open (ACT 306). If the cover is open (ACT 306: YES), the process returns to ACT 301. If the cover is not open (ACT 306: NO), the process returns to ACT 305.

In ACT 305, when an image formation execution request is issued (ACT 305: YES), the control unit 400 proceeds to ACT 401 of FIG. 18. In ACT 401, the control unit 400 attempts to acquire temperature information (ACT 401). Since the temperature information is updated every minute, the control unit 400 acquires the latest temperature information when performing image formation.

The control unit 400 determines whether the temperature information is acquired (ACT 402). When the temperature information is not acquired (ACT 402: NO), the control unit 400 determines whether the acquisition of the temperature information failed for three consecutive times (ACT 408).

If the acquisition of the temperature information failed for three consecutive times (ACT 408: YES), the control unit 400 determines the category from the temperature information stored in the DRAM 310 (ACT 404). If the acquisition of the temperature information did not fail for three consecutive times (ACT 408: NO), the control unit 400 attempts to acquire the temperature information again (ACT 401).

When the temperature information is acquired in ACT 402 (ACT 402: YES), the control unit 400 copies the temperature information (ACT 403). Thereby, the temperature information stored in the DRAM 310 is updated to the latest temperature information. The control unit 400 determines the category from the temperature information stored in the DRAM 310 (ACT 404).

The control unit 400 acquires the corrected temperature from the category (ACT 405). The control unit 400 corrects the fixing temperature based on the acquired temperature and controls the fixing unit 42 to be at the corrected temperature (ACT 406). The control unit 400 forms an image (ACT 407) and returns to ACT 305.

FIG. 19 is a view illustrating the presence of an offset when the second example is applied to some cases and when the second example is not applied. FIG. 19 illustrates "detected temperature", "accumulated time", "category", and presence of an offset for an application example or a non-application example. "Detected temperature", "accumulated time", and "category" are the same as "detected temperature", "accumulated time", and "category" described in FIG. 10. The test environment and the like are the same as those described in FIG. 15.

As illustrated in FIG. 19, in the application example, the presence of an offset in Category 1, Category 2, and Category 3 is indicated. In the non-application example, the presence of an offset in Category 1 and Category 2 is illustrated.

As illustrated in FIG. 19, it is illustrated that no offset occurred in all application examples. On the other hand, it is illustrated that an offset occurred in all non-application examples. It is illustrated that the occurrence of an offset is actually prevented by applying the second example.

In the example described above, when determining the category, the control unit 400 acquires the temperature zone having the largest accumulated time from the temperature information and determines the category based on the temperature zone. In this case, for example, if the accumulated time of 35° C. or higher and lower than 40° C. is 60 minutes, and if the accumulated time of 40° C. or higher is 59 minutes, the difference is only 1 minute, but a temperature zone of 35° C. or higher and lower than 40° C. is acquired.

When acquiring the largest temperature zone, all information other than the largest temperature zone will be discarded. Therefore, in the case where the accumulated times are almost same to each other, there is a possibility that the toner is far from the state of actually being exposed. Therefore, the method described below may be adopted.

First, a value is assigned for each temperature zone. For example, 0 is set in the temperature zone of less than 35° C., 1 is set in the zone of 35° C. or higher and lower than 40° C., and 2 is set in the zone of 40° C. or higher. Every time a temperature is detected, the value assigned to the temperature zone to which the detected temperature belongs is accumulated. In order to determine the category from the accumulated value, a threshold value to be compared with the accumulated value is set in advance.

Specifically, it is assumed that below 35° C. is detected 10 times, 35° C. or higher and below 40° C. is detected 60 times, and 40° C. or higher is detected 59 times. At this time, the accumulated value is 0×10 times+1×60 times+2×59 times=178. The threshold values are set to 50 and 100. If the accumulated value that is less than 50 is determined as Category 1, and if the accumulated value that is 50 or more and less than 100 is determined as Category 2, and the accumulated value that is 100 or more is determined as Category 3. At this time, since 178 is 100 or more, it is determined as Category 3. By doing so, the information of each temperature zone is not discarded, and thus it is possible to perform temperature correction according to the state of the exposed toner.

In the example described above, three categories are taken as an example, but two or four or more categories may be used. Three temperature zones are described as an example, but two or four or more temperature zones may be used.

As described above, the characteristic information is determined by the characteristics of the toner. Therefore, the category determination information and the correction information are determined by the characteristics of the toner. Specifically, the "detected temperature" and "accumulated time" in the category determination information are also values determined by the characteristics of the toner. The "corrected temperature" of the correction information is also a value determined by the characteristics of the toner. Therefore, no matter what property the toner has, the characteristic information is determined according to the toner, and thus the occurrence of offset can be prevented according to the toner.

In the present example, two examples are described, but both examples have the following (1) and (2) in common.

(1) To correct by using the temperature at which the toner is exposed and the accumulated time.

(2) To correct the fixing temperature to be higher as the temperature at which the toner is exposed is higher or as the accumulated time is longer.

Therefore, any example may be used as long as the above (1) and (2) are satisfied. For example, no matter how the temperature is detected, the occurrence of an offset can be prevented by satisfying the above (1) and (2).

The installation position of the temperature sensor 41 in the example described above is near the toner cartridge, and is preferably a position where the detected temperature is the highest. The mounting position of the IC chip 45 is preferably a position where the detected temperature is the highest. The position where the temperature sensor 41 and the IC chip 45 are installed does not matter as long as the temperature affecting the toner can be accurately detected.

In the first example, the temperature information stored in the DRAM 310 may be stored in the toner cartridge 30. By doing so, even when the toner cartridge 30 is set in another image forming apparatus, this image forming apparatus can acquire an appropriate corrected temperature.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a detector that detects temperature information of a temperature of a toner stored in a toner cartridge;

an image forming device that forms a toner image on a sheet with the toner supplied from the toner cartridge;

a fixing unit that fixes the toner image formed on the sheet by the image forming device; and a controller that controls a fixing temperature in the fixing unit according to the temperature information having a longest accumulated time and an accumulated time from a combination of the temperature information detected by the detector and the accumulated time in which the temperature information is detected.

2. The image forming apparatus according to claim 1, wherein the controller acquires characteristic information determined by characteristics of the toner, and the characteristic information comprises information for correcting the fixing temperature based on the combination of the temperature information and the accumulated time.

3. The image forming apparatus according to claim 1, wherein characteristic information is stored in a non-transitory storage medium provided in the toner cartridge, and the controller acquires the characteristic information from the non-transitory storage medium.

4. The image forming apparatus according to claim 3, wherein the non-transitory storage medium stores information for determining whether the toner cartridge is a genuine toner cartridge.

5. The image forming apparatus according to claim 1, wherein characteristic information comprises information for correcting the fixing temperature to be higher as at least one of the temperatures indicated by the temperature information is higher or the accumulated time is longer.

6. The image forming apparatus according to claim 1, wherein the detector detects information indicating a temperature in the image forming apparatus in which the toner cartridge is stored as the temperature information on the temperature of the toner.

7. The image forming apparatus according to claim 1, wherein the detector detects a temperature inside the image forming apparatus.

8. A toner cartridge for storing a toner, comprising:

a non-transitory storage medium that stores characteristic information for correcting a fixing temperature when a toner image formed on a sheet is fixed by a toner supplied from the toner cartridge, wherein the characteristic information comprises information for correcting the fixing temperature according to temperature information having a longest accumulated time and an accumulated time from a combination of the temperature information detected by a detector and the accumulated time in which the temperature information is detected.

9. The toner cartridge according to claim 8, wherein the characteristic information comprises information for correcting the fixing temperature to be higher as at least one of a temperature indicated by a temperature information on a temperature of the toner stored in the toner cartridge is higher or as an accumulated time in which the temperature information is detected is longer.

10. The toner cartridge according to claim 8, wherein the non-transitory storage medium stores information for determining whether the toner cartridge is a genuine toner cartridge.

11. The toner cartridge according to claim 8, wherein the temperature information comprises information indicating a temperature in an image forming apparatus in which the toner cartridge is stored.

12. The toner cartridge according to claim 8, wherein the characteristic information comprises information for correcting the fixing temperature based on the combination of the temperature information and an accumulated time in which the temperature information is detected.

13. The toner cartridge according to claim 8, wherein the non-transitory storage medium comprises a dynamic random access memory.

14. An image forming method, comprising:

detecting temperature information of a temperature of a toner stored in a toner cartridge;

forming a toner image on a sheet with the toner supplied from the toner cartridge;

fixing the toner image formed on the sheet; and controlling a fixing temperature according to the temperature information having a longest accumulated time and the accumulated time from a combination of the temperature information detected and the accumulated time in which the temperature information is detected.

15. The image forming method according to claim 14, further comprising:

acquiring characteristic information determined by characteristics of the toner, the characteristic information comprises information for correcting the fixing temperature based on a combination of the temperature information and the accumulated time.

16. The image forming method according to claim 15, wherein the characteristic information is stored in a non-transitory storage medium provided in the toner cartridge, and further comprising:

acquiring the characteristic information from the non-transitory storage medium.

17. The image forming method according to claim 16, wherein the non-transitory storage medium stores information for determining whether the toner cartridge is a genuine toner cartridge.

18. The image forming method according to claim 15, wherein the characteristic information comprises information for correcting the fixing temperature to be higher as at least one of the temperatures indicated by the temperature information is higher or the accumulated time is longer.

19. The image forming method according to claim 14, further comprising:

detecting information indicating a temperature in an image forming apparatus in which the toner cartridge is stored as the temperature information on the temperature of the toner.

20. The image forming method according to claim 14, wherein the detecting the temperature information comprises detecting a temperature inside an image forming apparatus.

* * * * *